United States Patent [19]

Diehl et al.

[11] 4,225,325

[45] Sep. 30, 1980

[54] STEAM SEPARATOR WITH VARIABLY SIZED RECTANGULAR INLET OPENING

[75] Inventors: Robert J. Diehl, Vivian; William L. Godare, Shreveport, both of La.

[73] Assignee: W-K-M Wellhead Systems, Inc., Shreveport, La.

[21] Appl. No.: 48,339

[22] Filed: Jun. 14, 1979

[51] Int. Cl.³ ..... B04C 5/04

[52] U.S. Cl. ..... 55/191; 55/204; 55/418; 210/512 R; 251/205

[58] Field of Search ..... 55/191, 198, 204, 418, 55/419; 251/118, 205; 210/512 R

[56] References Cited

U.S. PATENT DOCUMENTS

| | | | |
|---|---|---|---|
| 2,883,148 | 4/1959 | Williams | 251/205 |
| 3,516,551 | 6/1970 | Wallen et al. | 210/512 R |
| 3,658,289 | 4/1972 | Hodges | 55/418 |
| 4,163,726 | 8/1979 | Wilson et al. | 210/512 R |

*Primary Examiner*—John Adee

*Attorney, Agent, or Firm*—Stephen T. Belsheim

[57] ABSTRACT

A cyclone type steam separator (10) having a square inlet opening (46) which may be adjusted in size by means of an inlet control device (20). The device includes a rigid body (62) having perpendicular arms which form two sides of the square opening. The other two sides are formed by sliding bars (108 and 110) which are connected slidably with the arms and which overlap with one another to define a stationary corner of the opening. The body may be adjusted to vary the effective length of each side of the opening, with one side remaining on the outer side of the inlet conduit to direct the incoming fluid into the steam separator along the inside surface of the separator vessel.

13 Claims, 6 Drawing Figures

STEAM SEPARATOR WITH VARIABLY SIZED RECTANGULAR INLET OPENING

BACKGROUND OF THE INVENTION

This invention relates generally to steam separators and deals more particularly with a cyclone type separator having a square inlet opening which is adjustable in size.

Cyclone steam separators utilize centrifugal force to effect impact of the water droplets of an incoming steam-water mixture against the wall of the separator vessel. The water then drains downwardly into a water chamber located at the bottom of the vessel. The steam is less affected by the centrifugal force and rises into a steam chamber at the top of the vessel where it is collected and subsequently supplied to power generating equipment or used for another purpose. In order to impact maximum swirling motion to the incoming steam-water mixture, steam separators typically have inlets which deliver the mixture either tangent to or in a spiral path relative to the cylindrical inside surface of the vessel. In addition, it is desirable for the inlet opening to be square so that the incoming mixture makes straight line contact with the vessel wall rather than point contact as occurs with a circular inlet opening to the separator. Such line contact permits the fluid to flow smoothly along the vessel wall which streamlines the inlet flow and enhances the swirling action to increase the separation effect.

Steam separators that are employed in connection with geothermal wells are supplied with well fluids that vary widely as to their composition, pressure, flow rate, and temperature. For efficient operation, it is necessary for the steam separator to be capable of handling a wide range of flow rates and pressure without appreciable reduction in its ability to effectively separate the steam from the water. In a typical geothermal installation, it has been found that the velocity of the fluid entering the separator should be a minimum of about 160 feet per second in order for the centrifugal force to be great enough to cause impingement of a satisfactory quantity of water against the vessel wall. On the other hand, if the inlet velocity is greater than about 200 feet per second, significant quantities of steam impact against the vessel wall along with the water, and the efficiency of the steam separator suffers accordingly. Therefore, the inlet velocity for a typical steam separator should be maintained within the range of about 160 to 200 feet per second and should be as close as possible to 180 feet per second, which is the ideal velocity for maximum separation effect. In the past, maintaining the inlet velocity within the desired range has been a difficult problem which has severely hampered the efficiency of cyclone steam separators.

SUMMARY OF THE INVENTION

The primary object of the present invention is to provide a cyclone steam separator in which the flow rate of the incoming fluid may be accurately controlled in order to compensate for pressure changes and other variables in the flow characteristics.

A related object of the invention is to provide, in a cyclone steam separator, an easily adjustable mechanism for varying the size of a square inlet opening to the separator vessel while maintaining the inlet in proper alignment with the inside surface of the vessel at all times.

Yet another object of the invention is to provide an adjustable mechanism of the character described which may be installed on a steam separator without requiring substantial modification of the separator or the associated equipment.

These and other advantages of the invention are achieved by providing a cyclone steam separator which is equipped with a square inlet conduit having an outer side which merges with the inside surface of the separator vessel. A control housing attached to the inlet conduit provides an adjustably sized square opening through which the incoming fluid flows toward the vessel. The size of the opening is varied by adjusting a main body section which is mounted for sliding movement in the housing. Perpendicular arms of the main body form a movable corner of the opening which moves toward and away from a stationary corner as the main body is moved within the housing. The stationary corner is located such that one side of the square opening is aligned with the outer side of the inlet conduit at all times. The arms of the main body cooperate with a pair of sliding bars and with raised portions of the housing to form the sides of the square opening. The effective length of each side of the opening is adjusted by movement of the main body, resulting in variation of the size of the opening without changing its shape or its aligned position with respect to the outer side of the inlet conduit. Accordingly, the incoming fluid is at all times directed into the vessel in a manner to smoothly flow along the inside surface thereof.

DESCRIPTION OF THE DRAWINGS

In the accompanying drawings which form a part of the specification and are to be read in conjunction therewith.

DETAILED DESCRIPTION OF THE INVENTION

Figure 1:
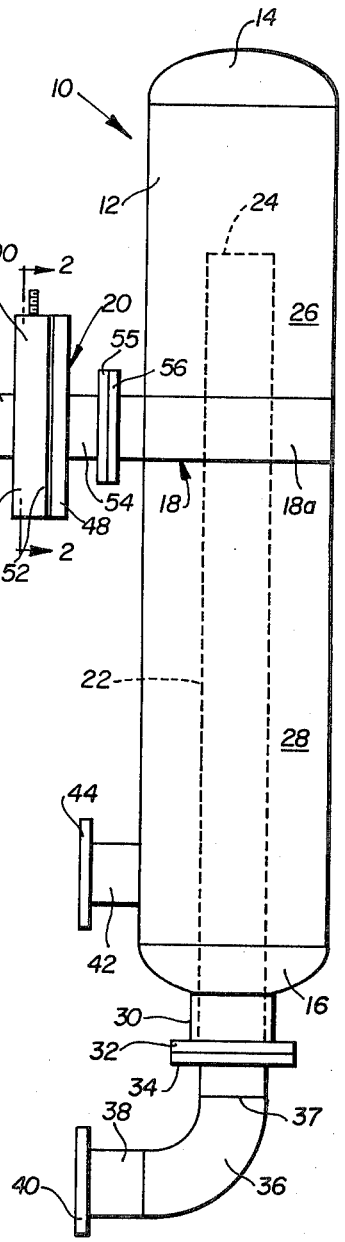
FIG. 1 is an elevational view of a bottom outlet cyclone steam separator which is equipped with an inlet control device for varying the size of a square inlet opening to the separator vessel in accordance with the present invention.

Referring now to the drawings in detail and initially to FIG. 1, a bottom outlet cyclone steam separator is generally designated by reference numeral 10. Steam separator 10 includes a cylindrical separator vessel 12 which is oriented vertically and covered at the top by a dome shaped cover 14. A similarly shaped base 16 is secured to the bottom end of vessel 12.

Incoming fluid containing a mixture of water and steam is delivered to vessel 12 through an inlet conduit 18. Inlet conduit 18 is square in cross-section and is preferably spiral shaped when viewed in plan such that its outer side 18*a* gradually merges with the cylindrical wall of vessel 12. Alternatively, conduit 18 can be a straight conduit of square cross-section which connects at its outer side 18*a* in a tangent relationship with the vessel wall. In any case, outer side 18*a* makes straight line contact with vessel 12 at its connection with the vessel wall, and fluid flowing into the vessel through conduit 18 thus makes initial line contact with the vessel wall and flows smoothly along the inside surface thereof. In accordance with the present invention, conduit 18 is provided with an inlet control device which is generally designated by numeral 20. Inlet control device 20 will be described in detail hereinafter.

A vertical steam outlet conduit 22 extends concentrically within vessel 12 and has an open top end 24 for receiving steam. End 24 is located well above inlet conduit 18 in a steam chamber 26 defined in the upper portion of vessel 12. A water chamber 28 is formed in the lower portion of vessel 12 below steam chamber 26.

Steam outlet conduit 22 extends through a cylindrical extension 30 which extends downwardly from base 16 and which has a flange 32 on its lower end. Another flange 34 is welded to flange 32 and to the outer surface of conduit 22 to form a seal at the bottom of water chamber 28. An elbow 36 is welded at 37 to the bottom end of conduit 22 and is welded at its opposite end to a short conduit 38 having a flange 40 on its outer end to facilitate connection with a flow conduit (not shown) which delivers steam to power generating equipment or for another use. A water outlet conduit 42 connects to the side of vessel 12 near the bottom of water chamber 28 in order to discharge water from the separator vessel 12. Conduit 42 has a flange 44 on its outer end for connection with a water line (not shown) which directs water away from vessel 12.

Inlet control device 20 provides a means for varying the size of a square opening 46 (see FIGS. 2 and 3) through which the incoming fluid passes as it approaches inlet conduit 18. The housing for device 20 includes an inner housing section 48 and an outer housing 50 which are secured together by bolts 51 (FIGS. 2 and 3) and are sealed to one another by a gasket 52. A short circuit 54 connects to the center of inner housing section 48 and has a flange 55 on its inner end which is connected with a flange 56 located on the outer end of conduit 18. Conduits 18 and 54 each have a square cross-section, and they are secured together in alignment with one another. A short conduit 58 having a flange 60 on its outer end connects with the center of outer housing section 50. Flange 60 facilitates connection with a fluid flowline (not shown) which leads from a geothermal well or another source of fluid containing water and steam.

Figure 4:
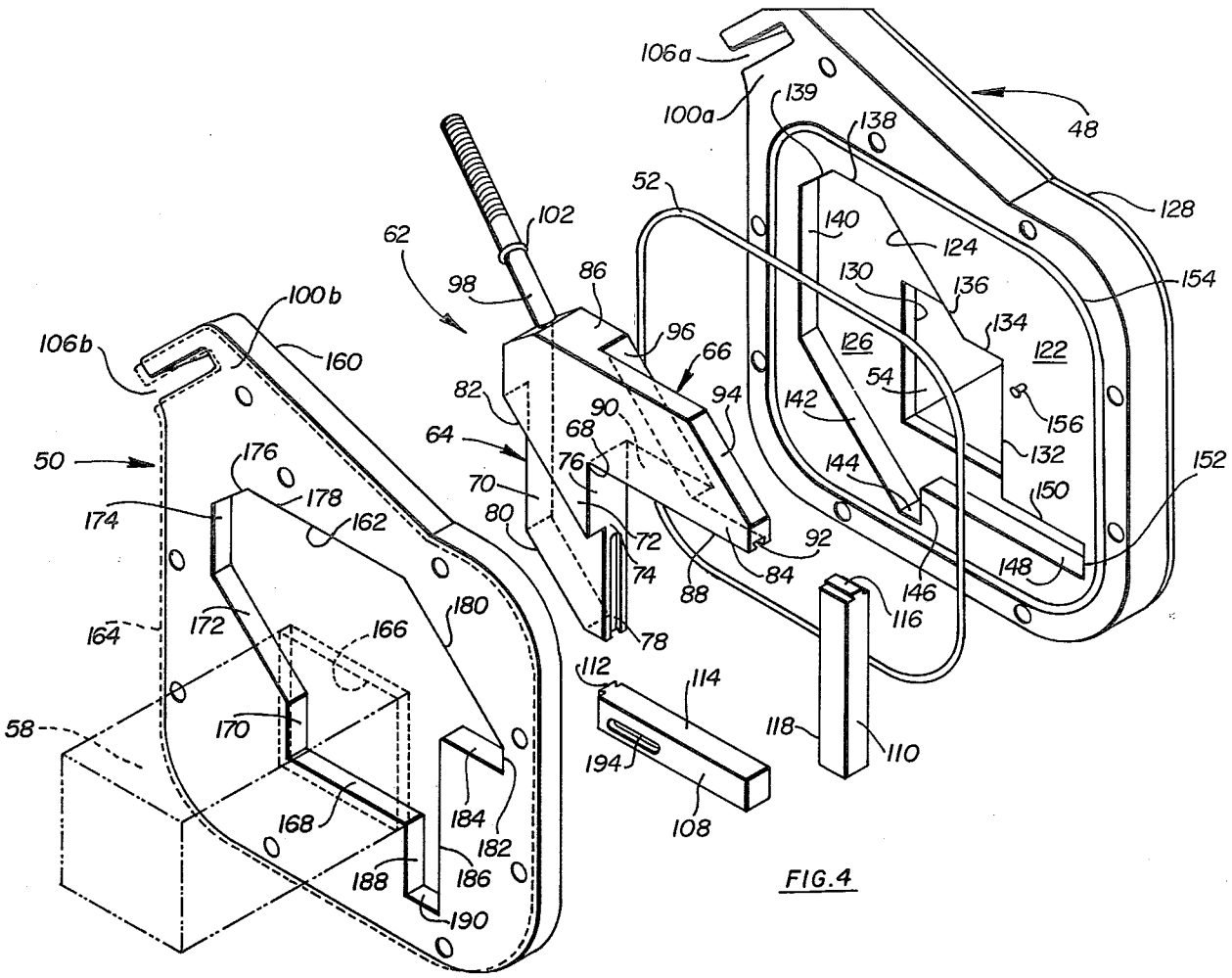
FIG. 4 is an exploded perspective view of the inlet control device, with selected components shown in broken lines for purposes of illustration.

With reference now to FIG. 4, in particular, housing sections 48 and 50 cooperate to present a hollow interior region within device 20 which receives and guides a rigid body generally designated by numeral 62. Body 62 is in the general shape of a chevron and includes a pair of arms 64 and 66 which are rigidly connected at a right angle to form a movable corner 68 of opening 46. Arm 64 is a vertical arm which forms a portion of the inner side of opening 46, while arm 66 is a horizontal arm which forms a portion of the top side of opening 46. Arm 64 has a long portion 70 which is wholly located in inner housing section 48 and a short portion 72 which is wholly located in outer housing section 50. Long portion 70 has a flat inwardly facing surface 74 which is coplanar with a shorter inwardly facing surface 76 on short portion 72. A dove-tail groove 78 is formed in surface 74. Groove 78 extends from the outer end of surface 74 and terminates well outwardly of the inner end thereof. The outer end of long portion 70 presents an angled surface 80 which is oriented at 45° relative to surface 74. The outer end of short portion 72 presents a similarly angled surface 82 which is parallel to surface 80 but located well inwardly thereof. Preferably, the length of surface 74 is approximately twice the length of surface 76.

The shape of arm 66 is identical to that of arm 64, although the arms are reversed as to their orientations and their positions in housing sections 48 and 50. Arm 66 has a long portion 84 located entirely within outer housing section 50, while a short portion 86 is located entirely within inner housing section 48. Inwardly facing surfaces 88 and 90 on the respective long and short arm portions 84 and 86 are coplanar and oriented at a right angle with respect to surfaces 74 and 76. Surface 88 is approximately twice as long as surface 90 in a preferred embodiment of the invention. Surface 88 is provided with a dove-tail groove 92 which extends inwardly from the outer end of long portion 84. An angled outer end surface 94 of arm portion 84 is oriented parallel to surfaces 80 and 82 and at a 45° angle with respect to surface 88. Short arm portion 86 has an angled outer end surface 96 which is parallel to surface 94 a considerable distance inwardly thereof.

Figure 2:
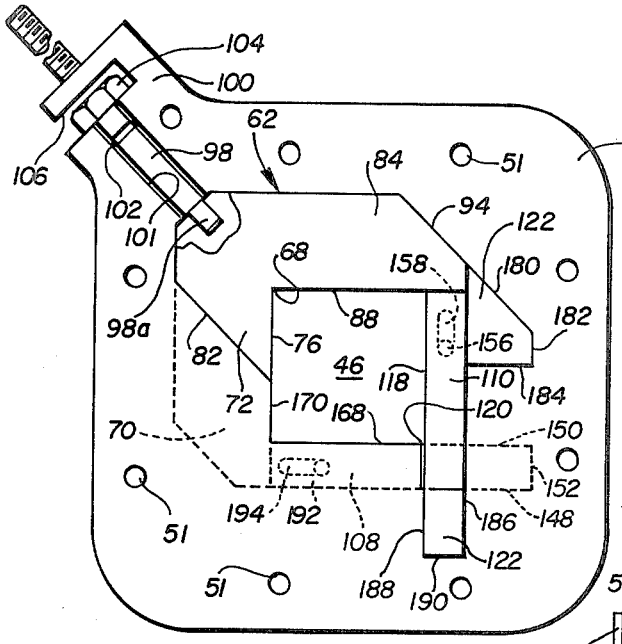
FIG. 2 is an enlarged sectional view of the inlet control device taken generally along line 2—2 of FIG. 1 in the direction of the arrows, with the square inlet opening presenting its maximum size.

Body 62 has a stem 98 which extends outwardly therefrom in a direction parallel to surfaces 80 and 94, or at 45° to the flat, inwardly facing surfaces of arms 64 and 66. As best shown in FIG. 2, the inner end 98*a* of stem 98 is reduced in diameter and is threaded into a thick portion of body 62 to connect stem 98 with body 62 in extension outwardly away from corner 68 of opening 46. The housing provided by housing sections 48 and 50 is generally rectangular and includes an outwardly projecting lug portion 100 formed at one corner by cooperating lugs 100*a* and 100*b* on the respective housing sections 48 and 50. Stem 98 extends through a passage 101 formed through lug 100 and carries an O-ring 102 which provides a seal within the passage. The outer end portion of stem 98 is threaded and receives a nut 104 which fits in a slot 106 formed in lug 100. Nut 104 is thus confined in slot 106 so that rotation of the nut in opposite directions moves stem 98 axially into and out of the housing, thereby moving body 62 along a predetermined path carrying the body in a direction longitudinally of stem 98. Slot 106 is formed partially in lug 100*a*, as indicated at 106*a*, and partially in lug 100*b*, as indicated at 106*b* in FIG. 4.

Figure 3:
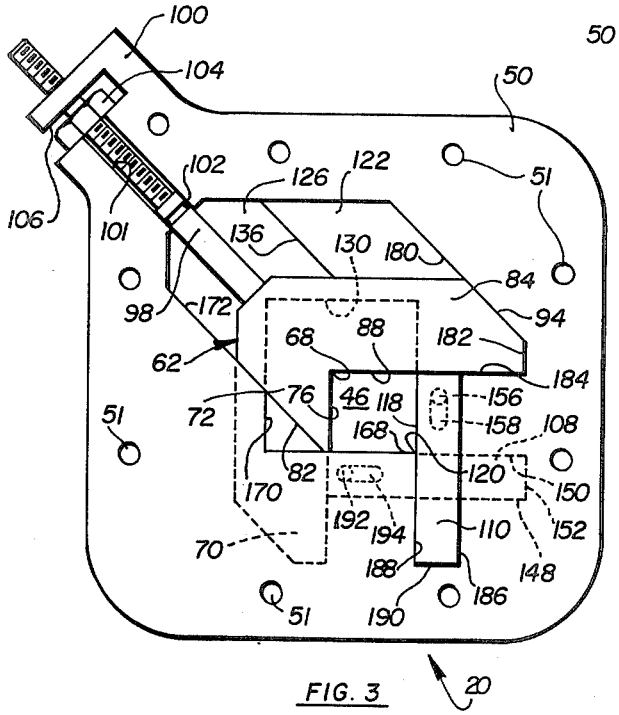
FIG. 3 is a sectional view of the inlet control device similar to FIG. 2, but with the square inlet opening presenting its minimum size.

With reference to FIG. 4 in particular, a pair of sliding bars 108 and 110 are connected for sliding movement on the respective arms 64 and 66. Bar 108 is a horizontal bar forming a portion of the bottom side of opening 46, while bar 110 is a vertical bar forming a portion of the outer side of opening 46. Bar 108 has a tongue 112 on one end which is slidably received in the dove-tail groove 78 of arm 64. A flat, inwardly facing surface 114 on bar 108 is oriented perpendicular to surfaces 74 and 76 of arm 64 and parallel to surfaces 88 and 90 of arm 66. Bar 110 has a tongue 116 on one end which is received in dove-tail groove 92 for sliding movement therein. Bar 110 has a flat, inwardly facing surface 118 which is perpendicular to surfaces 88, 90 and 114 and parallel to surfaces 74 and 76. The end portions of bars 108 and 110 opposite tongues 112 and 116 overlap one another in sliding relation and at a right angle to define a fixed corner 120 of opening 46 (FIGS. 2 and 3). As will subsequently be explained in more detail, surface 118 is aligned with the outer sides of conduits 54 and 58 at all times, and corner 120 is a stationary corner located on the outer side of the flow conduit leading to separator vessel 12.

Inner housing section 48 has a flat surface 122 which faces toward housing section 50. Formed in surface 122 is an opening which is indicated at 124. Opening 124 has an irregular contour and terminates at a flat surface 126 formed on a cover plate 128 of inner housing section 48. Surface 122 is thus a raised surface in comparison to surface 126 to provide a raised portion of housing section 48 surrounding opening 124. Cover plate 128 has a square opening 130 in the center thereof. Conduit 54 connects with plate 128 such that the sides of the conduit are aligned with the sides of opening 130.

As previously indicated, opening 124 presents an irregular contour on the raised portion of housing section 48. One side surface 132 of opening 124 is aligned with one side of opening 130, while a shorter side surface 134 is perpendicular to surface 132 in alignment with an adjacent side of opening 130. Surface 134 has a length less than one-half the length of the aligned side of opening 130. Extending at 45° to surface 134 is an angled guide surface 136. Surface 136 leads to a short surface 138 which is adjacent to another short surface 139. Surface 139 connects with a surface 140 which is parallel to surface 132. Another angled guide surface 142 extends from surface 140 in parallel relation to surface 136. The contour of opening 124 further includes a pair of short surfaces 144 and 146 which conform to the configuration of the outer end of arm portion 70. Parallel surfaces 148 and 150 are spaced apart a distance slightly greater than the width dimension of bar 108 and are connected at their outer ends by a short surface 152. Surface 150 connects with one end of side surface 132 at a right angle.

A groove 154 is formed in surface 122 at a location outside of opening 124 to receive the gasket 52 which is used to seal housing sections 48 and 50 to one another. A pin 156 projects from surface 122 and is closely received in a groove 158 (FIGS. 2 and 3) formed in the surface of bar 110 which faces toward housing section 48. Groove 158 extends lengthwise of bar 110 to assist in guiding the bar in lengthwise sliding movement, as will become clear.

Outer housing section 50 is shaped similarly to inner section 48 but is reversed relative thereto. A flat surface 160 is presented on the inwardly facing side of section 50 or the lower side as viewed in FIG. 4. Surface 160 fits against surface 122 of section 48 and is sealed thereto by gasket 52. An irregular opening 162 is formed in surface 160 and terminates at a flat surface formed on a cover plate 164 which is shown in broken lines in FIG. 4. Plate 164 is located on the outer side of housing section 50. Surface 160 is thus raised with respect to the surface of cover plate 164 to provide a raised portion of housing section 50. A square opening 166 is formed through plate 164 in alignment with opening 130 of plate 128. Conduit 58 connects with plate 164 and registers with opening 166 such that the sides of the conduit are aligned with the sides of the opening.

The contour presented by opening 162 on the raised portion of housing section 50 is identical to that of opening 124, although the openings are reversed as to their orientations. Opening 162 has a side surface 168 which lies along one side of opening 166. A shorter side surface 170 lies partially along an adjacent side of opening 166 but extends less than half the length of the corresponding side of the opening. An angled guide surface 172 connects with surface 170 and is oriented at 45° relative thereto. Short surfaces 174 and 176 are located at the end of guide surface 172. Surface 176 connects with a surface 178 which is oriented parallel to side surface 168. An angled guide surface 180 parallel to guide surface 172 is adjacent to surface 178. A pair of short surfaces 182 and 184 are located at the end of surface 180 and are shaped in conformity with the end of arm portion 84. Parallel surfaces 186 and 188 are connected at their ends by another short surface 190. Surfaces 186 and 188 are spaced apart a distance slightly greater than the width dimension of bar 110, and surface 188 connects with side surface 168 at a right angle. A pin 192 (FIGS. 2 and 3) projects inwardly from surface 160 and is closely received in a groove 194 formed in bar 108 in extension lengthwise thereof.

Inlet control device 20 is assembled by inserting body 62 in inner housing section 48 with bars 108 and 110 connected to arms 64 and 66 by means of tongues 112 and 116 and dove-tailed grooves 78 and 92. Stem 98 extends outwardly from body 62 through passage 101, and nut 104 is threaded onto the stem and is located in slot 106. Outer housing section 50 is then positioned against inner section 48 to enclose body 62 in the housing, with gasket 52 providing a fluid-tight seal between the housing sections. Bolts 51 are installed to secure the device in its assembled condition. Long portion 70 of arm 64 and short portion 86 of arm 66 are located wholly in inner housing section 48, as is bar 108. Bar 110, long portion 84 of arm 66, and short portion 72 of arm 64 are all located entirely in outer housing section 50. Arm portion 70 and bar 108 are sandwiched between surfaces 126 and 160 in sliding relation thereto, while arm portion 84 and bar 110 are sandwiched between surface 122 and the inside surface of cover plate 164 in sliding relation thereto. Short arm portion 86 is slidable on surface 126, while short arm portion 72 is slidable on the inside surface of plate 164.

Figure 6:
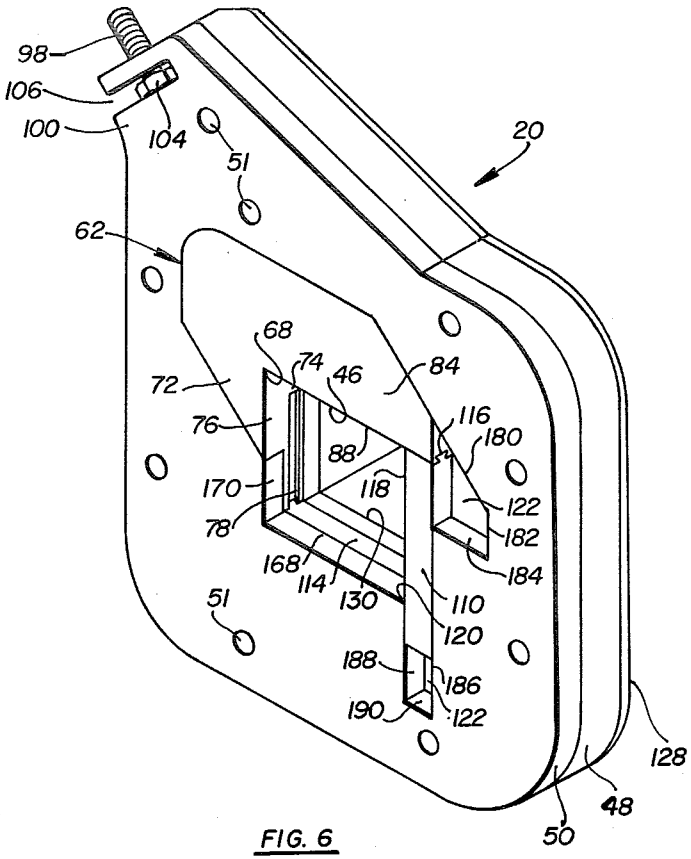
FIG. 6 is another perspective view of the inlet control device with the cover plate of the outer housing section removed for purposes of illustration.
Figure 5:
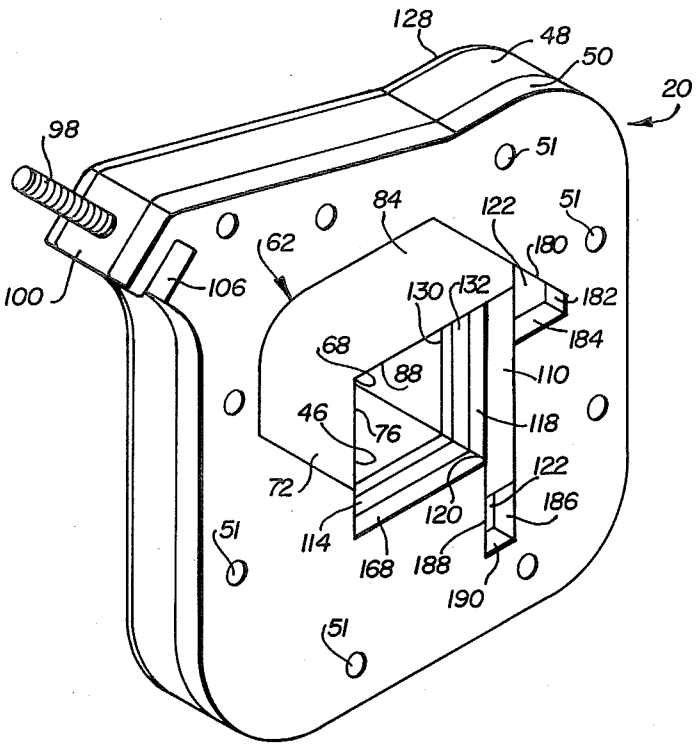
FIG. 5 is a perspective view of the inlet control device, with the cover plate of the outer housing section removed for purposes of illustration.

In use, inlet control device 20 permits the size of opening 46 to be adjusted in order to compensate for variations in the flow characteristics of the incoming fluid. Such adjustment is carried out by rotating nut 104 to advance stem 98 in threaded fashion in order to move body 62 inwardly and outwardly in a direction longitudinally of stem 98. When the stem is threaded out of the housing to its maximum extent, opening 46 presents its maximum size, as shown in FIG. 2 and also in FIGS. 5 and 6. When the components are in this position, surfaces 74 and 76 of arm 64 cooperate with surface 170 of housing section 50 to form one side of opening 46 adjacent corner 68. The other side of opening 46 adjacent corner 68 is formed by surfaces 88 and 90 of arm 66 in cooperation with surface 134 of inner housing section 48. One side of opening 46 adjacent stationary corner 120 is formed by surface 114 of bar 108 in cooperation with surface 168 of outer housing section 50. The last side of opening 46 is formed by cooperation between surface 118 of bar 110 and surface 132 of housing section 48, and it is to be noted that the last side of opening 46 is on the outer side of the flow conduit in alignment with the outer sides of conduits 54 and 58 and openings 130 and 166 at all positions of the inlet control device.

When nut 104 is turned in a direction to extend stem 98 into the housing from the position of FIG. 2, body 62 is moved in a direction to carry movable corner 68 directly toward stationary corner 120. Guide surface 136 and 142 of housing section 48 engage end surface 96 of short arm portion 86 and end surface 80 of long arm portion 70, respectively, to assist in guiding body 62 along the proper path. Similarly, end surface 82 of short arm portion 72 and end surface 94 of long arm portion 84 slide against the respective guide surfaces 172 and 180 of outer housing section 50 to provide guidance for body 62.

Body 62 thus moves inwardly along a path oriented at 45° to each side of opening 46. Long portion 70 of arm 64 slides relative to surface 168 and bar 108 such that the effective length of surface 74 from corner 68 to surfaces 114 and 168 is decreased, thereby decreasing the effective length of the corresponding side of opening 46. In a similar fashion, long portion 84 of arm 66 slides relative to bar 110 and surface 132 to decrease the effective length of surface 88. This decreases the effective length of the corresponding side of opening 46. Tongue 112 slides in dove-tail groove 78, and arm portion 70 at the same time pushes bar 108 in sliding movement in a direction lengthwise of the bar along surfaces 126 and 160. Bar 108 moves toward surface 152 and is guided by surfaces 148 and 150 in cooperation with the guidance provided by the close fit of pin 192 in groove 194. Such movement of bar 108 decreases the effective length of surface 114 between arm 64 and corner 120 to thereby decrease the length of the corresponding side of opening 146. Bar 110 is likewise pushed in a direction lengthwise thereof by arm portion 84, with tongue 116 sliding in groove 92. Bar 110 slides toward surface 190 between surfaces 186 and 188, with additional guiding action provided by the close fit of pin 156 in groove 158. The effective length of surface 118 between arm 66 and corner 120 is thus reduced such that the effective length of the corresponding side of opening 46 is reduced.

The side of opening 46 defined by surface 118 of bar 110 in cooperation with surface 132 of housing section 48 remains on the outer side of the flow conduit at all times, as does the stationary corner 120. Bars 108 and 110 are restricted to sliding movement lengthwise thereof to remain parallel to the inwardly facing surfaces of the respective arms 66 and 64. Also, the path of body 62 results in the length of each side of opening 46 being varied in direct proportion to the remaining sides of the opening, and the square shape of opening 46 is thus maintained at all positions of the control mechanism and at all sizes of the opening.

The minimum size of opening 46 is presented in the position of FIG. 3 wherein short arm portions 72 and 86 contact housing surfaces 168 and 132, respectively. In this position, the sides of opening 46 adjacent movable corner 68 are formed wholly by the inwardly facing surfaces of arms 64 and 66 since housing surfaces 170 and 134 are blocked off from opening 46 by arm portions 72 and 86. At positions of body 62 between the minimum size (FIG. 3) and the maximum size (FIG. 2), there is a small gap between surface 168 and the end of arm portion 72 and also between surface 132 and the end of arm portion 86. Such small gaps do not adversely effect the flow characteristics to a significant extent because opening 46 has continuous sides at all other portions thereof. In this respect, it is pointed out that surfaces 114 and 168 are coplanar at all times, surfaces 118 and 132 are coplanar at all times, and the inwardly facing surfaces of arms 64 and 66 are coplanar at all times.

It should be apparent that the size of opening 46 may be increased by turning nut 104 in the opposite direction to move body 62 outwardly. As this occurs, opening 46 is increased in size while maintaining its square configuration. As opening 46 increases in size, each component of device 20 is moved in a direction opposite the direction it moves when the opening is decreased in size.

The vertical, inwardly facing surface 118 of bar 110 is located on the outer side of the flow conduit at all times, as previously indicated. Consequently, the incoming fluid flowing to steam separator 10 flows along the outer side of opening 46 and along the outer sides of conduits 54 and 18 into the steam separator in smooth flow along the inside surface of vessel 12. The centrifugal action that results from the swirling motion of the incoming fluid causes the water to impact against the wall of the vessel, along with salt and other impurities. The water and impurities then drain downwardly into water chamber 28 from which they are discharged through conduit 42. The steam, being lighter than the water and impurities, is less affected by the centrifugal forces and rises into steam chamber 26 where it enters the top end 24 of conduit 22. The steam is discharged from the vessel through conduit 22, elbow 36, and conduit 38 into a steam flowline (not shown) which delivers the steam to power generating equipment or the like.

It should be pointed out that opening 46 need not be square but can instead be rectangular with sides of different lengths and still deliver fluid smoothly along the inside surface of vessel 12. The present invention contemplates such a rectangular opening, although a square shape is preferred due to the improved flow characteristics that result in most cases. As an alternative to nut 104, adjustment of the size of opening 46 can be carried out by an actuator which may be connected with body 62 in a suitable manner and operated either manually or by means of power driven equipment.

What is claimed is:

1. In a centrifugal action cyclone steam separator having a separator vessel with a cylindrical inside surface, the improvement comprising:

an inlet conduit connected with the vessel to deliver incoming fluid containing water and steam thereto for separation of the water and steam in the vessel, said inlet conduit having a substantially rectangular cross-section and an outer side which connects with said inside surface of the vessel;

a variably sized rectangular opening in said inlet conduit having one side on the outer side of the inlet conduit to direct fluid passing through the opening along said outer side; and means for varying the size of said opening in a manner to continuously maintain the rectangular shape thereof and to continuously maintain said one side of the opening on the outer side of the inlet conduit, whereby fluid passing through said opening is directed along said outer side of the inlet conduit and along said inside surface of the vessel at all sizes of opening, said means including at least two adjacent movable sides defining said rectangular opening and a single adjusting means for moving the two movable sides simultaneously.

2. The improvement set forth in claim 1, wherein said one side of the opening terminates at a stationary corner of the opening which is in a fixed position on said outer side of the inlet conduit at all sizes of the opening.

3. A device for varying the size of a rectangular inlet opening which receives incoming fluid containing water and steam flowing to a cyclone steam separator, said device comprising:

a hollow housing presenting said opening therein;

a rigid body mounted in said housing for reciprocal sliding movement along a predetermined path to adjust the opening between minimum and maximum sizes thereof, said body having rigidly connected first and second arms defining portions of respective first and second sides of the opening, said arms intersecting at a right angle to form a movable corner of the opening;

a first slidable bar member oriented parallel to said first arm to define a portion of a third side of the opening, said first bar member having one end connected to said second arm for sliding movement along the second arm to vary the effective length thereof in response to sliding movement of said rigid body along said path;

a second slidable bar member oriented parallel to said second arm to define a portion of a fourth side of the opening, said second bar member having one end connected to said first arm for sliding movement along the first arm to vary the effective length thereof in response to sliding movement of said rigid body along said path;

said first and second bar members overlapping one another to define a stationary fixed corner of the opening opposite said movable corner thereof; and means for sliding each bar member in a direction lengthwise thereof in response to sliding movement of said body along said path, thereby varying the effective length of each bar member while maintaining the first and second bar members parallel to the respective first and second arms to maintain the rectangular shape of the opening;

whereby sliding movement of said body along said path effects sliding movement of each arm and each bar member in a manner to vary the effective length thereof while maintaining the rectangular shape of the opening.

4. A device as set forth in claim 3, including:

inner and outer sections of said housing secured together with the inner section closer to the steam separator than the outer section;

a first raised housing portion located wholly in said inner housing section with said first arm and said second bar member received in the housing for sliding movement against said first raised housing portion, said first raised portion cooperating with said first arm and with said second bar member to define the respective first and fourth sides of the rectangular opening; and a second raised housing portion located wholly in said outer housing section with said second arm and said first bar member received in the housing for sliding movement against said second raised housing portion; said second raised portion cooperating with said second arm and with said first bar member to define the respective second and third sides of the rectangular opening.

5. A device as set forth in claim 4, including guide surfaces on said first and second raised portions engaging the respective first and second arms in a manner to guide said rigid body along said predetermined path.

6. A device as set forth in claim 4, including means adjacent said first and second raised portions for guiding said first and second bar members in lengthwise sliding movement against the raised portions.

7. A device as set forth in claim 4, including:

a long portion of said first arm located in the outer housing section and a short portion of said first arm located in the inner housing section, said long and short portions of the first arm presenting coplanar inwardly facing surfaces thereon;

a long portion of said second arm located in the inner housing section and a short portion of said second arm located in the outer housing section, said long and short portions of the second arm presenting coplanar inwardly facing surfaces thereon;

a pair of perpendicular surfaces on said first raised portion which cooperate with said inwardly facing surfaces of the first arm and with an inwardly facing surface of the second bar member to define the respective first and fourth sides of the rectangular opening; and a pair of perpendicular surfaces on said second raised portion which cooperate with said inwardly facing surfaces of the second arm and with an inwardly facing surface of the first bar member to define the respective second and third sides of the rectangular opening.

8. A device as set forth in claim 3, wherein the effective lengths of said arms and bar members are equal to one another at all times to maintain the opening in a square configuration, said movable corner of the opening moving toward and away from said fixed corner thereof upon movement of said body along said predetermined path.

9. A device for varying the size of a rectangular opening through which fluid passes in a fluid flow conduit having a stationary side, said device comprising:

a hollow housing connected with the flow conduit and presenting the rectangular opening therein;

a rigid body received for sliding movement in said housing along a predetermined path to vary the size of the rectangular opening;

first and second arms on said rigid body having inwardly facing surfaces defining portions of respective first and second sides of the opening which intersect at a right angle at a movable corner of the opening;

a first bar member having an inwardly facing surface oriented parallel to the inwardly facing surface of said first arm in extension along said stationary side of the flow conduit to define a portion of a third side of the opening, said first bar member being mounted for lengthwise sliding movement in the housing;

means connecting one end of said first bar member for sliding movement along the second arm to vary the effective length of the second side of the opening in response to movement of said body along said path, said first bar member sliding lengthwise thereof to vary the effective length of the third side of the opening in response to movement of said body along said path;

a second bar member having an inwardly facing surface oriented parallel to the inwardly facing surface of said second arm to define a portion of a fourth side of the opening, said second bar member being mounted for lengthwise sliding movement in the housing and overlapping with said first bar member to define a fixed corner of the opening opposite to said movable corner thereof;

means connecting one end of said second bar member for sliding movement along the first arm to vary the effective length of the first side of the opening in response to movement of said body along said path, said second bar member sliding lengthwise thereof to vary the effective length of the fourth side of the opening in response to movement of said body along said path; and means for effecting movement of said body along said path to vary the effective length of each side of the opening while maintaining the inwardly facing surface of said first bar member on said stationary side of the flow conduit, thereby varying the size of the opening while maintaining the rectangular shape thereof and maintaining the third side of the opening on said stationary side of the conduit at all times.

10. A device as set forth in claim 9, wherein said arms and bar members are arranged such that each side of the opening has an effective length equal to the effective length of the other sides to maintain the opening in a square configuration at all times, said movable corner moving toward and away from said fixed corner upon movement of said body along said path.

11. A device as set forth in claim 9, including:

a first raised portion of said housing cooperating with said inwardly facing surfaces of said first arm and said second bar member to define the respective first and fourth sides of the opening, said first raised housing portion presenting a flat surface against which said first arm and second bar member are mounted for sliding movement in response to movement of said body along said path; and a second raised portion of the housing cooperating with said inwardly facing surfaces of said second arm and said first bar member to define the respective second and third sides of the opening, said second raised housing portion representing a flat surface against which said second arm and first bar member are mounted for sliding movement in response to movement of said body along said path.

12. A device as set forth in claim 11, wherein said first and second raised housing portions present guide surfaces thereon which engage said body in a manner to guide same along said path.

13. A device as set forth in claim 11, wherein said housing includes first and second housing sections secured to one another, said first and second raised housing portions being located wholly within the respective first and second housing sections.

* * * * *